US006176094B1

(12) United States Patent
Ohta et al.

(10) Patent No.: US 6,176,094 B1
(45) Date of Patent: Jan. 23, 2001

(54) REFRIGERATING MACHINE OIL COMPOSITION, AND REFRIGERATION AND COMPRESSOR USING THE REFRIGERATING MACHINE OIL COMPOSITION

(75) Inventors: Ryou Ohta, Hitachi; Yutaka Ito, Takahagi; Kenichi Kawashima, Hitachinaka; Juichi Arai, Katsura-mura; Tadashi Iizuka, Ashikaga, all of (JP)

(73) Assignee: Hitachi, Ltd., Tokyo (JP)

( * ) Notice: Under 35 U.S.C. 154(b), the term of this patent shall be extended for 0 days.

(21) Appl. No.: 09/149,221

(22) Filed: Sep. 8, 1998

(30) Foreign Application Priority Data

Sep. 9, 1997 (JP) ..... 9-243678

(51) Int. Cl.[7] ..... F25B 41/00

(52) U.S. Cl. ..... 62/114

(58) Field of Search ..... 252/67, 68; 62/467, 62/468, 469, 114

(56) References Cited

U.S. PATENT DOCUMENTS 5,294,356 * 3/1994 Tanaka et al. ..... 252/56
5,579,651 * 12/1996 Sugiyama et al. ..... 62/469

* cited by examiner

*Primary Examiner*—William Doerrler
*Assistant Examiner*—Malik N. Drake
(74) *Attorney, Agent, or Firm*—Antonelli, Terry, Stout & Kraus, LLP

(57) ABSTRACT

The present invention relates to a refrigerating machine oil composition, which is composed of a base oil as a main component containing a single component of a compound or a mixture of compounds selected from the group consisting of cyclic carbonates and aliphatic carbonate derivatives. For example, the refrigerating machine oil composition is characterized by that the single component of a compound or the mixture of compounds selected from the group consisting of cyclic carbonates and aliphatic carbonate derivatives are expressed by the following general chemical formulas for cyclic carbonates (1) and aliphatic carbonate derivatives (2):

(1)

(2)

($R_1$, $R_2$ in the formula (1) respectively and independently express a hydrogen atom or a fluorine atom or an alkyl having a carbon number of 1 to 4, or a perfluoroalkyl having a carbon number of 1 to 3. Therein, $R_1$ and $R_2$ may be the same or different from each other. $R_3$, $R_4$ in the formula (2) respectively and independently express an alkyl having a carbon number of 1 to 4 or a perfluoroalkyl having a carbon number of 1 to 3. Therein, $R_3$ and $R_4$ may be same or different from each other.)

An object of the present invention is to provide a refrigerating machine oil having an excellent wear resistance, a refrigeration system working medium and a refrigeration system using the refrigerating machine oil, and a compressor used in the refrigeration system.

12 Claims, 5 Drawing Sheets

REFRIGERATING MACHINE OIL COMPOSITION, AND REFRIGERATION AND COMPRESSOR USING THE REFRIGERATING MACHINE OIL COMPOSITION

BACKGROUND OF THE INVENTION

The present invention relates to a refrigerating machine oil composition for a refrigerating machine and an air-conditioner, a working medium for a refrigeration system of a refrigerant compressing type and a refrigerator and a compressor, and, more particularly, to a refrigerator, a room air-conditioner and a package air-conditioner.

The use of CFC12 (dichlorodifluoromethane) for a refrigerator or a car air-conditioner has been abolished completely according to the chlorofluorocarbon regulation. Further, the use of HCFC22 (monochlorodifluoro-methane), which is being used for an air-conditioner or the like at the present time, is also to be abolished completely from the viewpoint of environmental protection. An alternative refrigerant under consideration is an HfC (hydrofluorocarbon) group refrigerant having a boiling point temperature near those of CFC12 and HCFC22 or a mixed refrigerant obtained by mixing two or more kinds of the HFC group refrigerants.

A refrigerating machine oil is used in a compressor of a refrigerating machine or an air-conditioner, such as a refrigerator, a room air-conditioner, a package air-conditioner, a freezer or the like, to lubricate, seal and cool the moving parts. In recent years, refrigerating machine oil has come to be used under more severe conditions with increasing demand for energy-saving, reduced size, low noise and high efficiency operation of the compressor. Therefore, a refrigerating machine oil which has a good lubricity, and is particularly good in wear resistance, is required in order to maintain the reliability of the compressor. In regard to a refrigerating machine oil, a naphthene group mineral oil, a paraffin group mineral oil and alkylbenzene have been widely used, since they have a better miscibility with the CFC (chlorofluorocarbon) group and the HCFC (hydrochloroflouoro-carbon) group refrigerants and are low in cost. However, these refrigerating machine oils cannot be dissolved in the HFC group refrigerants proposed as an alternative refrigerant. Polyol-ester of an aliphatic group synthetic oil having a polar group in the molecule has been developed as a refrigerating machine oil which is miscible with the HFC group refrigerants, and is disclosed in Japanese Patent Application Laid-Open No. 62-13912, PCT National Patent Publication No. 3-505602 and Japanese Patent Application Laid-Open No. 4-183788.

Further, since a HFC group refrigerant does not contain chloride in the molecule, a lubrication effect produced by the refrigerant itself cannot be expected at all compared to the conventional refrigerants. Therefore, the refrigerating machine oil is required to have a better lubricity.

Various kinds of additives are used in common refrigerating machine oils, and a lubricity improving agent is one of them. For example, phosphor compounds of a tertiary phosphate group, such as triphenylphosphate, tricresylphosphate and the like, are known lubricity improving agents (SAKURAI, Toshio, Additives for Petroleum Products, Saiwai Shobou, May 15, 1973). In regard to lubricity improving agents for the refrigerating machine oils applicable to HFC group refrigerants, there are (1) secondary phosphites and acidic phosphates (Japanese Patent Application Laid-open No. 4-28792), (2) phosphate ester of polyoxyalkylenealkyl ether (Japanese Patent Application Laid-Open No. 62-79295), (3) secondary phosphites or amine salts of acidic phosphites (Japanese Patent Application Laid-Open No. 63-90597, Japanese Patent Application Laid Open No. 3-39400). (4) organic molybdenum compounds (Japanese Patent Application Laid-Open No. 5-39494) and so on. However, none of these additives exhibits sufficient effects with respect to wear resistance and reliability, particularly in comparison to polyole-ester. In addition to this, there is the disadvantage that the reliability of the compressor is decreased, since these additives are low in thermal stability and in miscibility with hydrofluorocarbon group refrigerants or refrigerating machine oils.

Of the compressors for refrigerators and air-conditioners, there are a displacement type compressor such as a scroll type, a reciprocal type, a screw type, and vane rotary type compressors, and a volume type compressor such as a turbo type compressor. Particularly, the scroll type compressor among these compressors requires a refrigerating machine oil having an excellent wear resistance because slide bearings are used under a severe friction condition.

SUMMARY OF THE INVENTION

An object of the present invention is to provide a refrigerating machine oil composition having an excellent wear resistance, a refrigeration system working medium and a refrigeration system using the refrigerating machine oil, and a compressor used in the refrigeration system.

The present invention provides a refrigerating machine oil composition having a base oil containing a cyclic carbonate or aliphatic carbonate derivatives, preferably carbonates expressed by the following general chemical formulas (1) and (2).

Further, in the working medium for a refrigeration system composed of a hydrofluorocarbon group refrigerant or a hydrocarbon group refrigerant and a refrigerating machine oil, the working medium for a refrigeration system in accordance with the present invention contains a single component of a compound or a mixture of compounds selected from the group consisting of cyclic carbonates and aliphatic carbonate derivatives expressed by the following general chemical formulas for cyclic carbonates (1) and aliphatic carbonate derivatives (2):

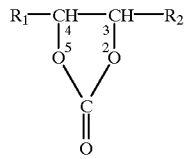

(1)

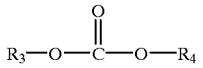

(2)

($R_1$, $R_2$ in the formula (1) respectively and independently express a hydrogen atom or a fluorine atom or an alkyl having a carbon number of 1 to 4, or a perfluoroalkyl having a carbon number of 1 to 3. Therein, $R_1$ and $R_2$ may be the same or different from each other. $R_3$, $R_4$ in the formula (2) respectively and independently express an alkyl having a carbon number of 1 to 4 or a perfluoroalkyl having a carbon number of 1 to 3. Therein, $R_3$ and $R_4$ may be the same or different from each other.)

The refrigerating machine oil composition in accordance with the present invention is characterized in that the cyclic carbonate expressed by the formula (1) is 3-trifluoromethyl-ethylenecarbonate.

The refrigerating machine oil composition in accordance with the present invention is characterized by that the aliphatic carbonate derivatives expressed in the formula (2) is dimethylcarbonate.

The refrigerating machine oil composition in accordance with the present invention is characterized by containing 0.01 to 5.0 weight % of the single component of a compound or the mixture of compounds selected from the group consisting of cyclic carbonates and aliphatic carbonate derivatives.

For a refrigeration system having a hydrofluorocarbon group refrigerant or a hydrocarbon group refrigerant and a refrigerating machine oil, the working medium in accordance with the present invention is characterized by containing a single component of a compound or a mixture of compounds selected from the group consisting of cyclic carbonates and aliphatic carbonate derivatives.

The working medium for a refrigeration system in accordance with the present invention is characterized by use of the refrigerating machine oil described above.

In a refrigeration system comprising a compressing means, a condensing means, an expanding means and an evaporating means, the refrigeration system in accordance with the present invention is characterized in that an operating medium for the refrigeration system having a hydrofluorocarbon group refrigerant and a refrigerating machine oil contains a single component of a compound or a mixture of compounds selected from the group consisting of cyclic carbonates and aliphatic carbonate derivatives.

In the refrigeration system described above, the refrigeration system in accordance with the present invention is characterized in that the single component of a compound or the mixture of compounds selected from the group consisting of cyclic carbonates and aliphatic carbonate derivatives is expressed by the following general chemical formulas for cyclic carbonates (1) and an aliphatic carbonate derivatives (2):

Chemical formulas 2

(1)

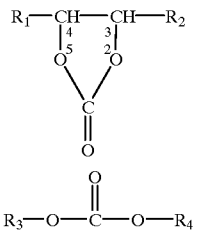

($R_1$, $R_2$ in the formula (1) respectively and independently express a hydrogen atom or a fluorine atom or an alkyl having a carbon number of 1 to 4, or a perfluoroalkyl having a carbon number of 1 to 3. Therein, $R_1$ and $R_2$ may be the same or different from each other. $R_3$, $R_4$ in the formula (2) respectively and independently express an alkyl having a carbon number of 1 to 4 or a perfluoroalkyl having a carbon number of 1 to 3. Therein, $R_3$ and $R_4$ may be the same or different from each other.)

The refrigeration system in accordance with the present invention is characterized in that the above-mentioned cyclic carbonate expressed by the formula (1) is 3-trifluoromethyl-ethylenecarbonate.

The refrigeration system in accordance with the present invention is characterized in that the above-mentioned chain carbonate expressed by the formula (2) is dimethylcarbonate.

The refrigeration system in accordance with the present invention is characterized in that the refrigerating machine oil contains 0.01 to 5.0 weight % of the single component of a compound or the mixture of compounds selected from the group consisting of cyclic carbonates and aliphatic carbonate derivatives.

In a compressor comprising a motor having a rotor and a stator, a rotating shaft fixed to the rotor, a circling scroll linked to the rotating shaft and a fixed scroll placed opposite to the circling scroll inside a gas-tight enclosure storing a working medium containing a refrigerant and a refrigerating machine oil, the refrigerant being compressed by driving of the circling scroll, the compressor in accordance with the present invention is characterized in that a working medium is composed of a hydrofluorocarbon group refrigerant or a hydrocarbon group refrigerant and a refrigerating machine oil as main components and contains a single component of a compound or a mixture of compounds selected from the group consisting of cyclic carbonates and aliphatic carbonate derivatives.

It is preferable that the above-mentioned compressor comprises the refrigerating machine oil described previously.

In a refrigerant compressor comprising a motor having a rotor and a stator, a rotating shaft fixed to the rotor, a compressor part connected to the motor through the rotating shaft contained in a gas-tight enclosure storing a working medium containing a refrigerant and a refrigerating machine oil, a high pressure refrigerant gas delivered out of the compressor part being stored in the gas-tight enclosure, the refrigerant compressor in accordance with the present invention is characterized in that the working medium is composed of a hydrofluorocarbon group refrigerant or a hydrocarbon group refrigerant and a refrigerating machine oil as main components and contains a single component of a compound or a mixture of compounds selected from the group consisting of cyclic carbonates and aliphatic carbonate derivatives.

The refrigerating machine oil composition in accordance with the present invention can be improved in lubricity by adding a single component of a compound or a mixture of compounds selected from the group consisting of cyclic carbonates and aliphatic carbonate derivatives. Further, by adding 3-trifluoromethyl-ethylenecarbonate of a cyclic carbonate compound to the refrigerating machine oil, abrasion of sliding portions can be substantially reduced by forming a chemical adsorbed film on the sliding surface. Furthermore, by using a hydrofluorocabon group refrigerant or a hydrocarbon group refrigerant and a refrigerating machine oil as a main component and by adding a single component of a compound or a mixture of compounds selected from the group consisting of cyclic carbonates and aliphatic carbonate derivatives, it is possible to obtain a working medium for a refrigeration system having an excellent lubricity. By setting the added quantity of the carbonate compound described above to 0.01 weight % to 5.0 weight %, it is possible to suppress abrasion of the sliding portions and to obtain a uniform-phase working medium for a refrigeration system which is not insoluble.

By using a hydrofluorocabon group refrigerant or a hydrocarbon group refrigerant and a refrigerating machine oil as a main component and by adding a single component of a compound or a mixture of compounds selected from the group consisting of cyclic carbonates and aliphatic carbonate derivatives, the refrigeration system in accordance with the present invention can be made to provide an excellent wear resistance in the compressor. Further, by adding 3-trifluoromethyl-ethylenecarbonate of a cyclic carbonate compound to the working medium for a refrigeration system, a chemical adsorbed film is formed on the sliding surfaces of the compressor, and, accordingly, abrasion of the sliding portions can be substantially reduced. By setting the added quantity of the carbonate compound described above to 0.01 weight % to 5.0 weight %, it is possible to suppress abrasion of the compressor and to obtain a long-term, highly reliable refrigeration system in which choking in the refrigeration system hardly occurs.

DESCRIPTION OF THE PREFERRED EMBODIMENTS

Figure 1:
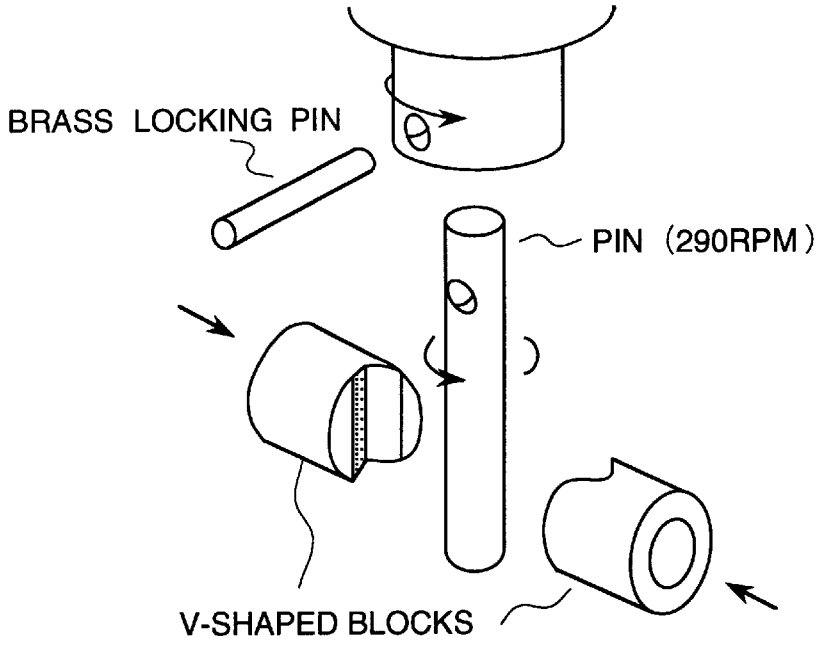
FIG. 1 is a perspective view showing the outline of a Falex friction test method.

In accordance with the present invention, the hydrofluorocarbonate group refrigerants of one of the components of the working medium for the refrigeration system are single components of 1, 1, 1, 2-tetrafluoroethane ($CF_3.CH_2F$; HFC134a), difluoromethane ($CH_2F_2$; HFC32), pentafluoroethane ($CF_3.CHF_2$; HFC125), 1, 1, 2, 2-tetrafluoroethane ($CHF_2.CHF_2$; HFC134), 1, 1, 1-trifluoroethane ($CF_3.CH_3$; HFC143a), or mixtures of two kinds or more of these hydrofluorocabonates such as R407C (HFC32/125/52:23/25/52 weight %), R410A (HFC32/125:50/50 weight %), R410B (HFC32/125/52:45/55 weight %). In a case where 410A is used as an alternative refrigerant in place of HCFC22, the outlet pressure of the compressor becomes nearly 1.6 times as high as that in a case of using HCFC22 when it is used under the same environment. Therefore, the compressor is used under a severe sliding condition. Hydrocarbon group refrigerants are single component refrigerants of propane, butane, isobutane, cyclopropane, and a mixed refrigerant of propane and isobutane.

Base oils for the refrigerating machine oil considered are polyol-ester, polyether, carbonate, naphthene group mineral oils, paraffin group mineral oils, alkyl-benzene and so on. Description will be made below of a typical base oil of polyole-ester among these. As for polyol-ester, there are polyol-ester synthesized from a multivalent alcohol and a univalent fatty acid and a complex type synthesized from a multivalent alcohol and a bivalent fatty acid or a mixed fatty acid of a bivalent and a univalent fatty acids. The multivalent alcohols are, for example, neopentyl glycol, trimethylpropane, penta-erythritol, dipentaerythritol. The univalent fatty acids are pentanoic acid, hexanoic acid, heptanoic acid, octanoic acid, 2-methyl-butanoic acid, 2-methyl-pentanoic acid, 2-methyl-hexanoic acid, isooctanoic acid, 3, 5, 5-trimethylhexanoic acid and so on, and one kind out of these or a mixed fatty acid composed of two or more kinds of these is used. The bivalent fatty acids are adipic acid, pimelic acid, suberic acid, azelaic acid, sebacic acid and so on.

A base oil particularly preferable for the refrigerating machine oil is at least one kind of oil selected from the group consisting of ester oils of fatty acids having at

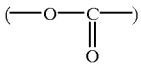

expressed by the following general chemical formulas (3) to (7).

$$(R_1.CH_2)_2.C.(CH_2COOR_2)_2 \quad (3)$$

$$R_1.CH_2.C.(CH_2COOR_2)_3 \quad (4)$$

$$C.(CH_2COOR_2)_4 \quad (5)$$

$$(R_2OOCH_2C)_3.C.CH_2.O.CH_2.C.(CH_2.COOR_2)_3 \quad (6)$$

(7)

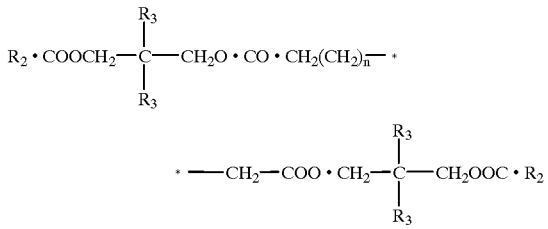

Therein, $R_1$: alkyl group having 1 to 3 of carbon atoms or hydrogen atoms or hydrogen atoms $R_2$: alkyl group having 5 to 12 of carbon atoms $R_3$: alkyl group having 1 to 3 of carbon atoms n: 0 or an integer of 1 to 5

As for the cyclic carbonates of ethylenecarbonate derivatives which are the lubricity improving agents, there are ethylene-carbonate, 3-methyl-ethylenecarbonate, 3-ethyl-ethylenecarbonate, 3-propyl-ethylenecarbonate, 3-butyl-ethylenecarbonate, 3,4-dimethyl-ethylenecarbonate, 3-ethyl-4-methyl-ethylenecarbonate, 3-propyl-4-methyl-ethylene-carbonate, 3-butyl-4-methyl-ethylenecarbonate, 3, 4-diethyl-ethylenecarbonate, 3-propyl-4-ethyl-ethylene-carbonate, 3-butyl-4-ethyl-ethylenecarbonate, 3,4-dipropyl-ethylenecarbonate, 3-butyl-4-propyl-ethylenecarbonate, 3,4-dibutyl-ethylenecarbonate and so on. As the cyclic carbonates substituted ethylene carbonate derivative with fluorine, there are 3-fluoroethylenecarbonate, 3,4-difluoro-ethylenecarbonate, 3-trifluoromethyl-ethylenecarbonate, 3-heptafluoropropyl-ethylenecarbonate, 3,4-bis (trifluoromethyl)-ethylenecarbonate, 3-pentafluoroethyl-4-trifluoromethyl-ethylenecarbonate, 3-heptafluoropropyl-4-trifluoromethyl-ethylenecarbonate, 3,4-bis (pentafluoroethyl)-ethylenecarbonate, 3-heptafluoropropyl-4-pentafluoroethyl-ethylenecarbonate, 3,4-bis (heptafluoropropyl)-ethylenecarbonate, 3-trifluoromethyl-4-methyl-ethylenecarbonate, 3-trifluoropropyl-4-methyl-ethylenecarbonate, 3-heptafluoropropyl-4-butyl-ethylenecarbonate and so on.

As the aliphatic carbonate derivatives, there are dimethylcarbonate, diethylcarbonate, dipropylcarbonate, dibutylcarbonate, methylethylcarbonate, methylpropylc, arbonate, methylbutyl-carbonate, ethylpropylcarbonate, ethylbutylcarbonate, propylbutylcarbonate and so on. As the chain carbonates substituted with fluorine, there are bis (trifluoromethyl)carbonate, bis(pentafluoromethyl) carbonate, bis(heptafluoropropyl)carbonate, methyl-trifluoromethylcarbonate, butyl-trifluoromethylcarbonate, methyl-heptafluoropropylcarbonate, butyl-lieptafluoropropyl-carbonate and so on. In addition to these, it is possible to mix the cyclic carbonates together, to mix the aliphatic carbonate derivatives together, or to mix the cyclic carbonate and the aliphatic carbonate derivatives. The ratio in which the cyclic carbonate or the aliphatic carbonate derivatives of the lubricity improving agent are added is 0.01 to 5.0 weight % to the refrigerating machine oil described previously, and it is preferable to add 0.1 to 1.0 weight %. When the ratio in which the cyclic carbonate or the aliphatic carbonate derivatives are added is less than 0.01 weight %, sufficient wear resistance cannot be obtained. On the other hand, when the ratio in which the cyclic carbonate or the aliphatic carbonate derivatives are added is larger than 5.0 weight %, the lubricity improving agent cannot be completely dissolved in the refrigerating machine oil thereby to cause choking in a dryer or a capillary tube.

The refrigerating machine oil composition can be added with an antioxidant, an acid getter, a defoamer, a metal deactivator and the like within a range not interfering with the object of the present invention.

By adding the cyclic carbonate or the aliphatic carbonate derivatives to the refrigerating machine oil, an adsorbed film is formed on sliding surfaces, so that metal-to-metal contact is prevented, the coefficient of friction is decreased, and the wear resistance is substantially improved.

In a refrigeration system comprising a compressing means, a condensing means, an expanding means and an evaporating means, the refrigeration system in accordance with the present invention is characterized in that an operating medium for the refrigeration system having a hydrofluorocarbon group refrigerant or a hydrocarbon group refrigerant and a refrigerating machine oil contains a single component of a compound or a mixture of compounds selected from the group consisting of cyclic carbonates and aliphatic carbonate derivatives.

In a refrigerant compressor comprising a motor having a rotor and a stator, a rotating shaft fixed to the rotor, a compressor part connected to the motor through the rotating shaft contained in a gas-tight enclosure storing a working medium containing a refrigerant and a refrigerating machine oil, a high pressure refrigerant gas delivered out of the compressor part being stored in the gastight enclosure, the refrigerant compressor in accordance with the present invention is characterized in that the working medium is composed of a hydrofluorocarbon group refrigerant or a hydrocarbon group refrigerant and a refrigerating machine oil as main components and contains a single component of a compound or a mixture of compounds selected from the group consisting of cyclic carbonates and aliphatic carbonate derivatives.

EMBODIMENTS 1 to 12

The following were used for the hydrofluorocabon group refrigerant (HFC), the refrigerating machine oil, and cyclic carbonates and aliphatic carbonate derivatives as the lubricity improving agent.

Hydrofluorocabon group refrigerant: HFC134a was used.

Refrigerating machine oil: Carboxylic acid ester of pentaerythritol was used. The viscosity grade was VG68.

Lubricity improving agents:

A: ethylenecarbonate

B: 3-methyl-ethylenecarbonate

C: 3-butyl-ethylenecarbonate

D: 3,4-dimethyl-ethylenecarbonate

E: 3-trifluoromethyl-ethylenecarbonate

F: dimethylcarbonate

G: dibutylcarbonate

H: methyl-ethyl-carbonate

I: di(trifluoromethyl)carbonate

J: C+E

K: F+G

L: E+I

With each refrigerating machine oil in which was added each of these lubricity improving agents by 0.5 weight % (in a case of each of the mixtures J, K and L, the weight ratio of the mixed compositions is 1:1.) to the refrigerating machine oil, wear resistance for each of the refrigerating machine oils was evaluated through the following method using a Falex tester. A rotating shaft (pin) of approximately 6 mm diameter was symmetrically sandwiched by two V-shaped blocks from side directions, and was dipped into the refrigerating machine oil contained in an oil cup. HFC134a was blown into the oil at a flow rate of 150 ml/min for 10 minutes to saturate the oil with the HFC134a. Further, HFC134a was blown into the oil during the test. The tester was operated for 5 hours under conditions of a load of 100 lb, an oil temperature of 100° C. and a rotating speed of 290 rpm. Then, a total wear depth ofthe pin and the V-shaped blocks was calculated from a change in load-calibrated scale of a ratchet, which is a loading mechanism of the Falex tester, and the calculated value was regarded as an wear loss. Therein, the tester was operated by setting the load to 50 lb until the oil temperature was increased from room temperature to 100° C.

A diagram of the Falex tester is shown in FIG. 1. The friction portions are the two V-shaped blocks and the pin rotated between the two V-shaped blocks, and the load is applied by automatically fastened arms and the application of load is performed by rotation of a ratchet gear. The pin is rotated at 290±10 rpm by a motor. Specification of the test piece is shown in Table 1.

TABLE 1

| | PIN | V-SHAPED BLOCK |
|---|---|---|
| SHAPE (mm) | 6.35φ × 25.4 | 12.7φ × 12.7<br>angle: 96° |
| MATERIAL | SAE 3135<br>(Ni-Cr steel) | AISI 1137<br>(free-cutting steel) |
| HARDNESS | $H_{RB}$ 87 TO 91 | $H_{RC}$ 20 TO 24 |
| SURFACE ROUGHNESS (10 point average) | 10 RMS MAX | 10 RMX MAX |

Comparative Examples 1 to 4

The following were used for the hydrofluorocabon group refrigerant (HFC), the refrigerating machine oil, and the lubricity improving agent.

Hydrofluorocabon Group Refrigerant:

HFC134a was used.

Refrigerating Machine Oil:

Carboxylic acid ester of pentaerythritol was used. The viscosity grade was VG68.

Lubricity Improving Agents:

M: tricresyl phosphate

N: dilauryl hydrogen phosphite

O: oleyl alcohol

The evaluation was performed under the same conditions as those in

EMBODIMENTS 1 to 9

Table 2 shows the result of the Falex test using polyolester. It is clear from Table 2 that the composition of the refrigerating machine oil in accordance with the present invention can decrease wear loss to as little as approximately 9 μm and is excellent in wear resistance, and, at the same time, can reduce the coefficient of friction to as little as 0.06 or lower compared to the case of the base oil alone and the cases of the lubricity improving agents used in the comparative examples.

Further, in Embodiment 5, a similar Falex friction test was conducted with a system not containing the refrigerant. The result showed that the wear loss was 6.9 μm and the coefficient of friction was 0.04, and accordingly it was confirmed that the wear and the friction coefficient could be reduced even in a system not containing a reffriferant.

Carboxylic acid ester of pentaerythritol (the viscosity grade was VG68)

Polyether (the viscosity grade was VG68)

Carbonate (the viscosity grade was VG68)

Naphthene group mineral oil (the viscosity grade was VG56)

Alkylbenzene (the viscosity grade was VG56)

With each refrigerating machine oil in which a lubricity improving agent was added to the refrigerating machine oil, wear resistance was evaluated under the following test conditions. The Falex tester was operated for 5 hours under conditions of an HFC134a flow rate of 150 ml/min (HCFC22 was bubbled in cases of naphthene group mineral oil and alkylbenzene), a load of 100 lb, an oil temperature of 100° C., a rotating speed of 290 rpm for 5 hours, and pre-operation with 50 lb load for 10 minutes. The wear loss was obtained through the same method as in Embodiment 1.

Table 3 shows the results produced by the embodiments and the comparative examples. It is clear from Table 3 that

TABLE 2

| | | BASE OIL | LUBRICITY IMPROVING AGENT (0.5 wt %) | RACHET SCAL wear (μm) | FRICTION COEFFICIENT |
|---|---|---|---|---|---|
| Embodiment | 1 | polyolester | A | 7.4 | 0.05 |
| | 2 | polyolester | B | 7.0 | 0.05 |
| | 3 | polyolester | C | 7.2 | 0.05 |
| | 4 | polyolester | D | 6.9 | 0.04 |
| | 5 | polyolester | E | 6.6 | 0.04 |
| | 6 | polyolester | F | 8.1 | 0.06 |
| | 7 | polyolester | G | 8.3 | 0.06 |
| | 8 | polyolester | H | 7.9 | 0.06 |
| | 9 | polyolester | I | 7.1 | 0.05 |
| | 10 | polyolester | J | 6.7 | 0.04 |
| | 11 | polyolester | K | 7.3 | 0.05 |
| | 12 | polyolester | L | 6.9 | 0.04 |
| Comparative Example | 1 | polyolester | none | 12.8 | 0.08 |
| | 2 | polyolester | M | 13.1 | 0.09 |
| | 3 | polyolester | N | 11.6 | 0.08 |
| | 4 | polyolester | O | 12.8 | 0.08 |

EMBODIMENTS 13 to 20

Comparative Examples 5 to 11

Next, using the Falex tester shown in FIG. 1, the wear resistance was evaluated with the ethylenecarbonate derivative E, which had been confirmed to be a cyclic carbonate capable of improving wear resistance in Embodiments 1 to 12 described above, and by varying the quantity of the lubricity improving agent which is added and the kind of refrigerating machine oil being used.

Hydrofluorocabon Group Refrigerant:

HFC134a was used.

Refrigerating Machine Oil:

the refrigerating machine oil composition in accordance with the present invention can decrease wear loss and is excellent in wear resistance regardless of the kind of base oil being used compared to the case of the base oil alone and the cases of the comparative examples. In addition to this in cases of adding the cylic carbonate or the aliphatic carbonate derivatives in an amount less than 0.01 weight % to the base oil, sufficient wear resistance could not obtained, as shown by Comparative example 6. Further, as shown by Comparative example 7, in a case of the refrigerating machine oil to which the cyclic carbonate was added in an amount more than 10 weight %, the test could not be performed because the cyclic carbonate could not be dissolved completely into the refrigerating machine oil.

TABLE 3

| | | BASE OIL | LUBRICITY IMPROVING AGENT | ADDED QUANTITY (wt %) | RACHET SCAL wear (μm) |
|---|---|---|---|---|---|
| Embodiment | 13 | polyole ester | E | 0.01 | 8.2 |
| | 14 | polyole ester | E | 0.5 | 6.6 |
| | 15 | polyole ester | E | 1.0 | 5.2 |
| | 16 | polyole ester | E | 5.0 | 5.0 |
| | 17 | polyether | E | 0.5 | 1.0 |
| | 18 | carbonate | E | 0.5 | 1.5 |
| | 19 | naphthene group mineral oil | E | 0.5 | 1.0 |
| | 20 | alkylbenzene | E | 0.5 | 3.1 |
| Comparative Example | 5 | polyole ester | none | — | 12.8 |
| | 6 | polyole ester | E | 0.005 | 12.8 |
| | 7 | polyole ester | E | 10.0 | (not dissolved completely) |
| | 8 | polyether | none | — | 18.7 |
| | 9 | carbonate | none | — | 14.8 |
| | 10 | naphtene group mineral oil | none | — | 3.0 |
| | 11 | alkylbenzene | none | — | 7.6 |

EMBODIMENTS 21 to 29

The following were used for the hydrocarbon group refrigerant (HC), the refrigerating machine oil, and cyclic carbonates and aliphatic carbonate derivatives as the lubricity improving agent.

Hydrocabon Group Refrigerant:

Isobutane was used.

Refrigerating Machine Oil:

Alkyl benzene was used. The viscosity grade was VG56.

LUBRICITY Improving Agents:

A: ethylenecarbonate

B: 3-methyl-ethylenecarbonate

C: 3-butyl-ethylenecarbonate

D: 3,4-dimethyl-ethylenecarbonate

E: 3-trifluoromethyl-ethylenecarbonate

F: dimethylcarbonate

G: dibutylcarbonate

H: methyl-ethyl-carbonate

I: di(trifluoromethyl)carbonate

With each refrigerating machine oil in which each of these lubricity improving agents was added in an amount of 0.5 weight % to the refrigerating machine oil wear resistance for each of the refrigerating machine oils was evaluated by the same method as in Embodiment 1. Isobutane was blown into the oil at a flow rate of 150 ml/min for 10 minutes to saturate the oil with the isobutane and was continuously added to the oil during the test.

Comparative Example 12

A Falex test in a system in which the lubricity improving agent was not used was performed with the hydrocarbon group refrigerant and the refrigerating machine oil described in Embodiments 21 to 29. The evaluating method was the same as in Embodiments 21 to 29.

Table 4 shows the result of the Falex friction test using the hydrocarbon group refrigerant and alkylbenzene. It is clear from Table 4 that the refrigerating machine oil composition in accordance with the present invention exhibits a wear loss as small as 3.0 μm or smaller and is excellent in wear resistance, and, at the same time, can reduce the friction coefficient to as little as 0.06 or lower compared to the case of the alkylbenzene oil alone.

TABLE 4

| | | BASE OIL | LUBRICITY IMPROVING AGENT (0.5 wt %) | RACHET SCAL wear (wt %) | FRICTION COEFFICIENT |
|---|---|---|---|---|---|
| Embodiment | 21 | alkylbenzene | A | 2.3 | 0.05 |
| | 22 | alkylbenzene | B | 2.0 | 0.05 |
| | 23 | alkylbenzene | C | 1.9 | 0.05 |
| | 24 | alkylbenzene | D | 1.2 | 0.04 |
| | 25 | alkylbenzene | E | 0.3 | 0.04 |
| | 26 | alkylbenzene | F | 2.0 | 0.06 |
| | 27 | alkylbenzene | G | 2.1 | 0.06 |
| | 28 | alkylbenzene | H | 1.8 | 0.06 |
| | 29 | alkylbenzene | I | 1.5 | 0.05 |

TABLE 4-continued

| | | BASE OIL | LUBRICITY IMPROVING AGENT (0.5 wt %) | RACHET SCAL wear (wt %) | FRICTION COEFFICIENT |
|---|---|---|---|---|---|
| Comparative Example | 12 | alkylbenzene | none | 10.2 | 0.10 |

EMBODIMENTS 30 to 37

Comparative Examples 13 to 17

Next, wear resistance was evaluated by Falex tests with the ethylenecarbonate derivative E, which had been confirmed to be a cyclic carbonate capable of improving wear resistance in Embodiments 21 to 29 described above, and by varying the quantity of the lubricity improving agent being added and the kind of refrigerating machine oil being used.

Hydrocabon Group Refrigerant:

Isobutane was used.

Refrigerating Machine Oil:

Carboxylic acid ester of pentaerythritol (the viscosity grade was VG68)

Polyether (the viscosity grade was VG68)

Carbonate (the viscosity grade was VG68)

Naphthene group mineral oil (the viscosity grade was VG56)

Alkylbenzene (the viscosity grade was VGS6)

With each refrigerating machine oil to which a lubricity improving agent was added and mixed with an appropriate ratio, wear resistance was evaluated under the following test conditions. The tester was operated for 5 hours under conditions of an isobutane flow rate of 150 ml/min, a load of 100 lb, an oil temperature of 100° C., a rotating speed of 290 rpm for 5 hours, and pre-operation with 50 lb load for 10 minutes. The wear loss was obtained through the same method as in Embodiment 1.

Table 5 shows the results provided by the embodiments and the comparative examples. It is clear from Table 5 that the refrigerating machine oil composition in accordance with the present invention can decrease wear loss and is excellent in wear resistance regardless of the kind of the base oil compared to the case of the base oil alone of the comparative examples. In addition to this, in a case of adding the cyclic carbonate or the chain carbonate in an amount less than 0.01 weight % to the base oil, sufficient wear resistance could not be obtained, as shown by Comparative example 14. Further, as shown by Comparative example 15, in a case where the refrigerating machine oil with the cyclic carbonate in an amount more than 10 weight %, the test could not be performed executed because the cyclic carbonate could not be dissolved completely into the refrigerating machine oil.

TABLE 5

| | | BASE OIL | LUBRICITY IMPROVING AGENT | ADDED QUANTITY (wt %) | RACHET SCAL wear (μm) |
|---|---|---|---|---|---|
| Embodiment | 30 | polyole ester | E | 0.01 | 8.5 |
| | 31 | polyole ester | E | 0.5 | 7.0 |
| | 32 | polyole ester | E | 1.0 | 5.7 |
| | 33 | polyole ester | E | 5.0 | 5.5 |
| | 34 | polyether | E | 0.5 | 1.0 |
| | 35 | carbonate | E | 0.5 | 2.5 |
| | 36 | naphthene group mineral oil | E | 0.5 | 1.0 |
| | 37 | alkylbenzene | E | 0.5 | 1.0 |
| Comparative Example | 13 | polyole ester | none | — | 14.8 |
| | 14 | polyole ester | E | 0.005 | 14.6 |
| | 15 | polyole ester | E | 10.0 | (not dissolved completely) |
| | 16 | polyether | none | — | 20.7 |
| | 17 | carbonate | none | — | 16.8 |
| | 18 | naphtene group mineral oil | none | — | 5.0 |
| | 19 | alkylbenzene | none | — | 10.2 |

EMBODIMENTS 38

Comparative Examples 18 to 20

Next, the thermal stability of the refrigerating machine oil was evaluated with the ethylenecarbonate derivative E, which had been confirmed to be a cyclic carbonate capable of improving wear resistance in Embodiments 1 to 12 described above. The base oil alone and the lubricity improving agent N were also used for the purpose of comparison.

Hydrofluorocabon Group Refrigerant:

R407C was used.

Refrigerating Machine Oil:

Carboxylic acid ester of pentaerythritol was used. The viscosity grade was VG.68.

A shield tube test was conducted by sealing the hydrofluorocarbon group refrigerant described above and the refrigerating machine oil in a glass ampule tube with a weight ratio of 1:1. The lubricity improving agent was added by 0.5 weight % to the refrigerating machine oil. The test oil was prepared so that water content in the oil was adjusted to 100 ppm and a catalyst was brought to be coexistent with copper, iron and aluminum, and then heated for 21 days at 175° C. After that, a total acid value was obtained by titrating 1/10 N-KOH aqueous solution (isopropanoic) to the test oil.

The evaluated results of the thermal stability are shown in Table 6. It is clear from Table 6 that the refrigerating machine oil composition in accordance with the present invention can suppress an increase of the total acid value to a small value and is excellent in thermal stability compared to the case of the base oil alone and the case of Comparative example 18. From the result, the cyclic carbonate and the aliphatic carbonate derivatives show not only the effect as a lubricity improving agent but also the effect of stabilizer to suppress hydrolysis of polyol-ester. Further, a change in the metallic catalyst was not observed.

Next, the miscibility between the hydrofluorocarbon group refrigerant and the refrigerating machine oil with the added lubricity improving agent was evaluated. The base oil alone and the lubricity improving agent 0 were also used for purpose of comparison.

Hydrofluorocabon Group Refrigerant:

R407C was used.

Refrigerating Machine Oil:

Carboxylic acid ester of pentaerythritol was used. The viscosity grade was VG68.

The miscibility between the hydrofluorocarbon group refrigerant and the refrigerating machine oil was evaluated according to the JIS K2211.

The evaluated results of the miscibility are shown in Table 6. It is clear from Table 6 that the refrigerating machine oil composition in accordance with the present invention does not obstruct the miscibility between the hydrofluorocarbon group refrigerant and the refrigerating machine oil and shows an excellent miscibility between the hydrofluorocarbon group refrigerant and the refrigerating machine oil compared to the case of the base oil alone and the case of Comparative example 19.

Next, the volume resistivity of the refrigerating machine oil with the added lubricity improving agent was measured. For purpose of comparison, the refrigerating machine oil alone was also used. The measured results of the volume resistivity are shown in Table 6. It is clear from Table 6 that the refrigerating machine oil composition in accordance with the present invention does not show decrease in volume resistivity compared to the case of the base oil alone.

EMBODIMENT 39

Figure 2:
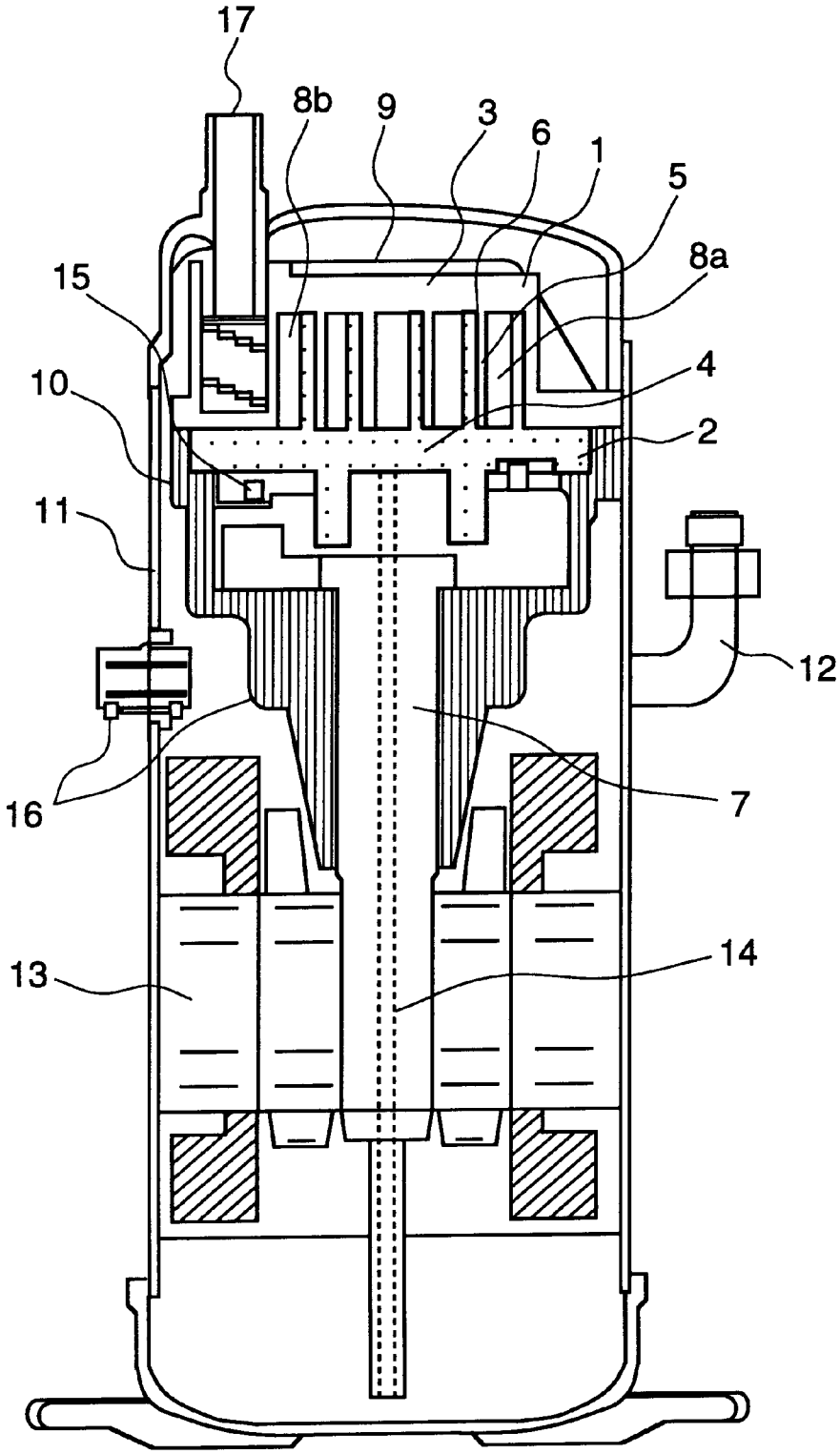
FIG. 2 is a cross-sectional view explaining a scroll type compressor.

FIG. 2 is a cross-sectional view showing a scroll type compressor using a refrigerating machine oil composition in accordance with the present invention. In the compressor, a compressing mechanism part is constructed by engaging a spiral lap 6 standing on an end plate 3 of a fixed scroll member 1 at right angle with a circling scroll member 2 composed of an end plate 4 having essentially the same shape as that of the fixed scroll member 1 and a lap 6 by causing the lap 5 and the lap 6 to face each other, and the circling scroll member 2 is circularly moved by a crank shaft 7 of a motion converting mechanism linked to a rotating shaft. A compressing chamber in the outermost position among chambers 8 (8*a*, 8*b*, . . . ) formed by the fixed scroll member 1 and the circling scroll member 2 is moved toward the center of both scroll members 1, 2 while the volume is gradually being reduced with the circling motion. The fixed and the circling scroll members are preferably made of a gray cast iron, and a combination of FC 25 or a combination of the gray cast iron for the fixed scroll member and an aluminum alloy, particularly a sintered alloy containing Si of 10 to 30 weight %, Cu of 2 to 5 weight % and at least one kind of a metal of 0.5 to 1.5 weight % selected from the group consisting of Mg, Fe, Mn, Zn and Ce for the circling scroll member is particularly preferable. The sintered alloy is preferably formed through high temperature hot working. The content of Si is preferably 15 to 25 weight %, and the content of the elements such as Mg and so on is preferably 0.5 to 1.0 weight %. An oxide film such as an aluminum oxide film is preferably formed on the surface of the aluminum alloy member from the viewpoint of corrosion protection.

Figure 3:
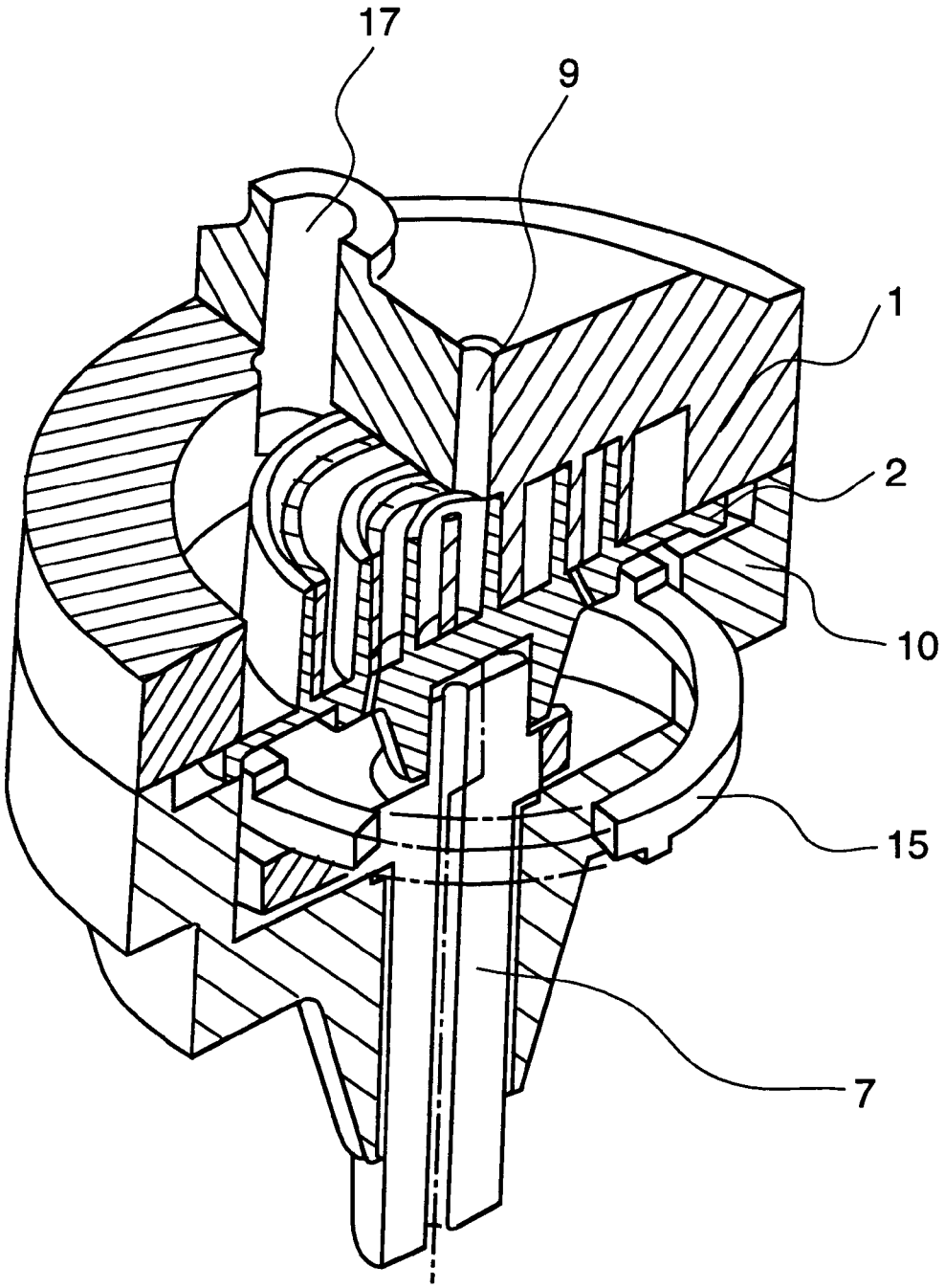
FIG. 3 is a partially sectional perspective view showing the scroll type compressor.

FIG. 3 is a perspective view showing an embodiment of a scroll type compressor in accordance with the present invention the construction of which is nearly the same as that in FIG. 2 except for the outlet port of the outlet pipe 12 of FIG. 2. In the compressor shown in FIG. 2, the compressing mechanism part is also constructed by a combination of the fixed scroll member 1 and the circling scroll member 2. Each of the compressors of FIG. 2 and FIG. 3 can be used for a room air-conditioner and has a refrigerant of approximately 1 kg and a refrigerating machine oil of approximately 350 cc.

When a both compressing chambers 8*a*, 8*b* come to a position near the center of the scroll members 1, 2, both compressing chambers 8*a*, 8*b* communicate with the outlet port 9 to discharge compressed gas in both compressing chambers. The compressed gas is discharged through the fixed scroll member 1 and a gas passage (not shown) placed in a frame 10 into a compressing container in the lower

TABLE 6

| | BASE OIL | LUBRICITY IMPROVING AGENT | THERMAL STABILITY (mg KOH/g) | TWO-LAYER SEPARATION TEMPERATURE (° C.) | VOLUME RESISTIVITY (Ω · cm) |
|---|---|---|---|---|---|
| Embodiment | 38 polyole ester | E | 0.012 | −13 | $1.1 \times 10^{14}$ |
| Comparative Example | 18 polyole ester | none | 0.302 | −13 | $1.0 \times 10^{14}$ |
| | 19 polyole ester | K | 0.584 | not measured | not measured |
| | 20 polyole ester | L | not measured | +18 | not measured |

portion of the frame and then is discharged to the outside of the compressor out of the outlet pipe 12 provided in a side wall of the compressing container 11.

In this compressor, an electric motor 13 is contained inside the compressing container 11, and a crank shaft 7 is rotated at a rotating speed corresponding to a voltage controlled by an inverter, not shown, outside the compressor to perform a compressing operation. An oil storage part is provided under the motor 13, and the oil is used to lubricate sliding surfaces between the circling scroll member 2 and the crank shaft 7, a sliding bearing 16 and so on through an oil hole 14 provided in the crank shaft 7.

Figure 4:
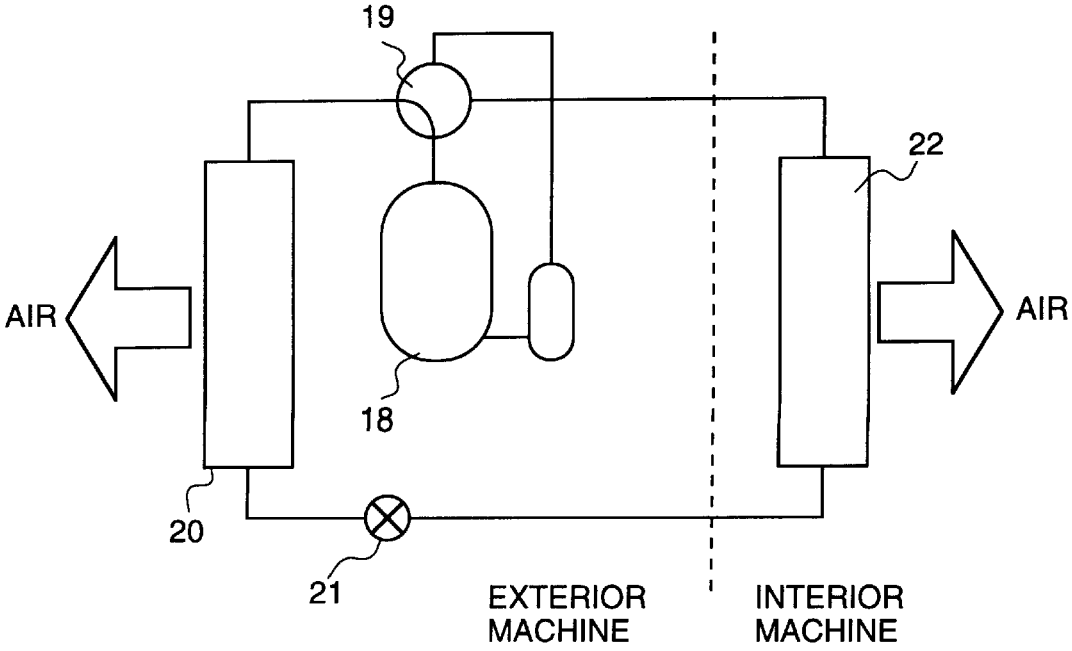
FIG. 4 is a diagram for explaining a refrigerating cycle of a refrigeration system.

Next, the refrigeration cycle will be described below. FIG. 4 is a diagram showing a heat pump refrigeration cycle such as used in a dual-purpose cooling and heating room air-conditioner or package air-conditioner.

In the case of cooling a room, an adiabatically compressed high pressure refrigerant gas from the outlet pipe of the compressor 18 flows through a four-way valve 19 and is cooled by an exterior heat exchanger 20 (used as a condensing means) so as to be converted to a high pressure liquid refrigerant. This refrigerant is athermally expanded in an expanding means 21 (for example, a capillary tube or a temperature type expanding valve) to be converted to a low temperature low pressure liquid containing a small amount of gas. The refrigerant flows to an interior heat exchanger 22 (used as an evaporating means) and then flows to the compressor 18 through the four-way valve 19 again in a state of low temperature gas by receiving heat from the air inside the room. In the case of heating the room, the flow of the refrigerant is changed to the opposite direction using the four-way valve 19 to perform an inverse operation.

Wear losses of the sliding bearing were compared by respectively using a refrigerating machine oil to which an ethylenecarbonate derivative E of the cyclic carbonate was added in an amount of 0.5 weight % as a lubricity improving agent and a refrigerating machine oil to which dilauryl-hydrogen phosphate N was added in an amount of 0.5 weight % as a lubricity improving agent to the refrigeration cycle incorporating the scroll type compressor of the present embodiment and by operating the refrigeration cycle for one hour under a constant condition.

R410A was used as the hydrofluorocarbon group refrigerant, and polyole-ester VG56 of the trimethylolpropane group was used as the refrigerating machine oil.

Since the sliding bearing was under the severest sliding condition in the scroll type compressor, the wear resistance was evaluated by measuring the wear amount of the shaft.

Figure 5:
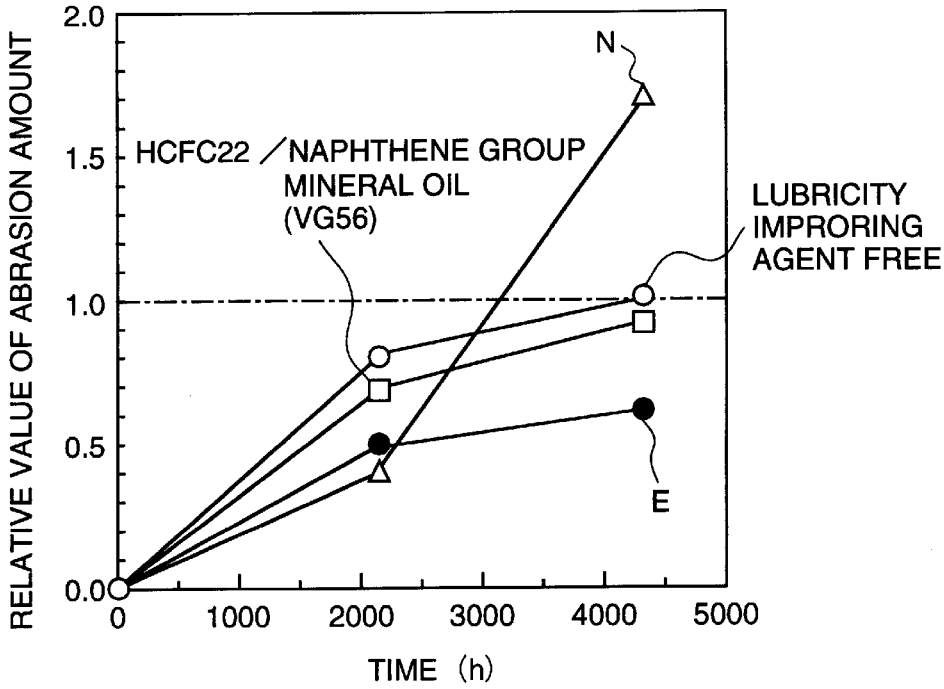
FIG. 5 is a graph showing the relation between shaft abrasion amount and time in of the present invention.
Figure 7:
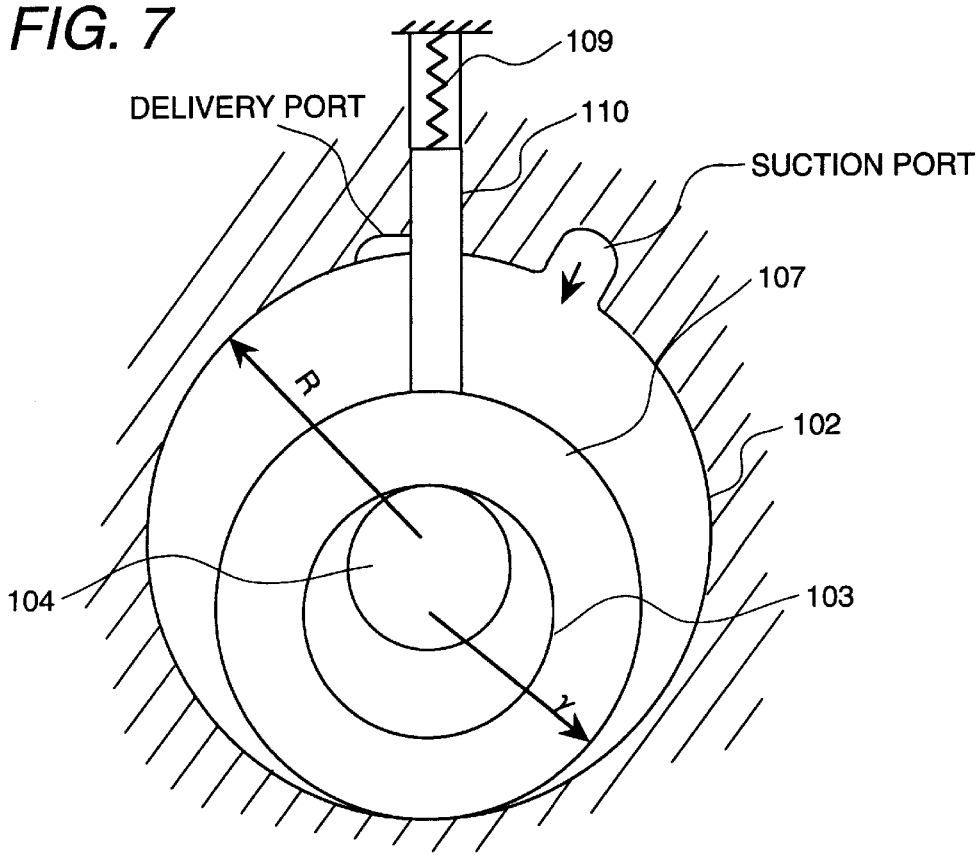
FIG. 7 is a cross-sectional view showing the main part of the rotating portion in the compressor of FIG. 6.

FIG. 5 shows the relationship between wear amount of the shaft and time. In the case of the refrigerating machine oil with dilauryl-hydrogenphosphite N, the wear amount was small in the initial period, but substantially increased as the friction time was increased. In addition to this, the total acid value of the oil after the test was high, not shown, because of its poor thermal stability and attached objects were observed in the capillary tube of the expanding means of the refrigeration cycle. On the other hand, in the case of the refrigerating machine oil alone, the wear amount was slightly larger compared to the case of the conventional combination of HCFC22/mineral oil, and the wear could not be suppressed sufficiently. On the contrary, in the case of the refrigerating machine oil with ethylenecarbonate derivative E of the cyclic carbonate as a lubricity improving agent, the wear amount was small compared with the case of refrigerating machine oil alone, the total acid value of the oil after the test was low, and choking of the capillary tube of the expanding means of the refrigeration cycle was not observed.

Further, wear resistance was evaluated by a 180-day test similar to the method described above by filling propane of a hydrocarbon group refrigerant and a naphthene group mineral oil in a refrigeration system incorporating the scroll type compressor in accordance with the present invention and using a refrigerating machine oil alone and a refrigerating machine oil to which ethylenecarbonate derivative E of a cyclic carbonate was added in an amount of 0.5 weight % as a lubricity improving agent. This test showed that in the case of the refrigerating machine oil with ethylenecarbonate derivative E, the wear loss was approximately ⅓ as small as that in the case of the refrigerating machine oil alone and the refrigerating machine oil with ethylenecarbonate derivative E had an excellent wear resistance.

It is confirmed from the above result that by adding a chemical compound alone or a mixture of chemical compounds selected from the group consisting of cyclic carbonates and the chain carbonates by more than 0.01 weight % to a refrigerating machine oil, the wear resistance of the refrigerating machine oil composition can be substantially improved and the coefficient of friction can be reduced regardless of the kind of refrigerating machine oils being used.

It is confirmed that by using the refrigerating machine oil composition in accordance with the present invention to a refrigeration system, wear of a sliding portion can be suppressed, and the refrigeration system is not choked and the reliability can be substantially improved.

Although description has been made above concerning the results of evaluation using an actual machine using only polyole-ester having a high miscibility with the alternative HFC group refrigerant not containing chlorine, the refrigerating machine oil composition in accordance with the present invention can be applied to a refrigeration system using a mineral oil or alkylbenzene immiscible with hydrofluorocarbon group refrigerants, for example, by providing an oil recovery mechanism for secure returning of oil from the refrigeration system to the compressor or by mixing a small amount of propane, isobutane or pentane to the hydrofluorocarbon group refrigerant. Further, the refrigerating machine oil composition may have an antioxidant, an acid getter, a defoamer, a metal deactivator and the like added thereto within a range not interfering with the lubricity and the miscibility with the refrigerant.

EMBODIMENT 40

Figure 6:
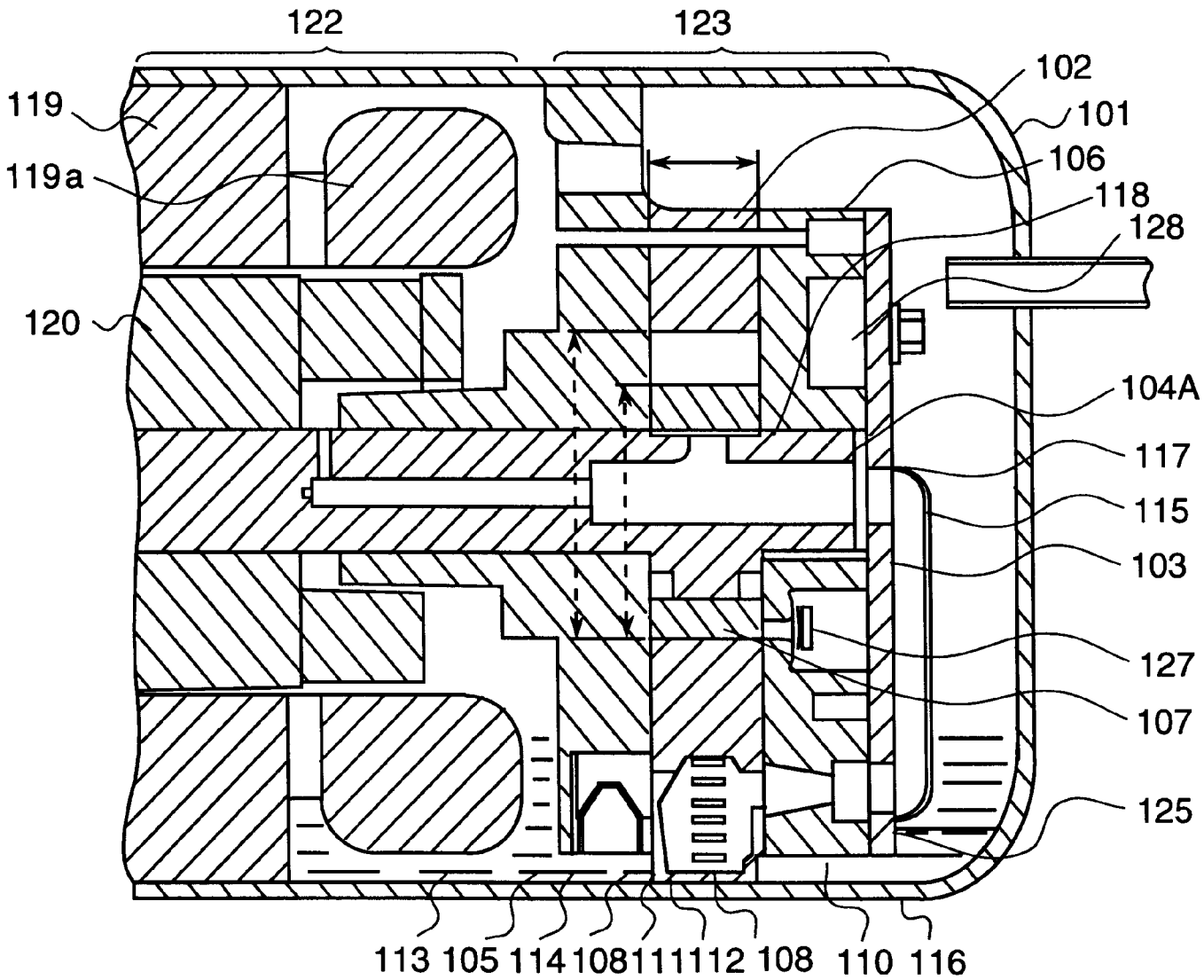
FIG. 6 is a cross-sectional view showing the main part of an enclosed rotary type compressor.

FIG. 6 is a cross-sectional view showing an enclosed type vane rotary compressor. In FIG. 6, the reference character 101 indicates a case forming a container also serving as an oil storage, and a motor part 122 and a compressing part 123 are contained in the case 101.

The motor 122 is composed of a stator 119 and a rotor 120, and a rotating shaft 104A made of cast iron is fixed to the rotor 120. The rotating shaft 104A has an eccentric part 103, and a hollow shaft hole 117 is formed in one end of the rotating shaft.

A core of wire of a winding portion 119*a* of the stator 119 is covered with an esterimide coating film, and an electric insulating film made of polyethyleneterephthalate is inserted between the core portion of the stator and the winding portion, and the surf ace of the rotor 104A is finished by grinding work.

The compressor 123 is mainly composed of a cylinder 102 made of an iron base sintering material, a roller 107 made of cast iron inserted into the eccentric portion 103 of the rotating shaft 104A and eccentrically rotating along the inside of the cylinder 102, a vane 110 made of a high speed steel reciprocally moving inside a groove 108 of the cylinder 102, while one end of the vane is maintained in contact with the roller 107 and the other end is pushed by a spring 109, a main bearing 105 and a sub-bearing 106 made of cast iron or an iron base sintering material arranged in both ends of the cylinder, the main bearing 105 and the sub-bearing 106 serving as bearings for the rotating shaft 104A and also as side walls of the cylinder 102.

The sub-bearing 106 has an outlet valve 127 and an outlet cover 125 attached so as to form a silencer 128, and the main bearing 105, the cylinder 102 and the sub-bearing 106 are fastened with bolts 121. A pump chamber 112 is formed by being surrounded with a back surface of the vane 110, the main bearing 105 and the sub-bearing 106.

The main bearing 105 has a sucking piece 114 capable of sucking a refrigerating machine oil 113A, in which there is dissolved a refrigerant gas stored in the bottom portion in the case 1, into the pump chamber 112, and the sub-bearing 106 has an outlet port 116 capable of discharging the refrigerating machine oil 113A from the pump chamber 112 to an oil delivery pipe 115. The oil delivery pipe 115 supplies the refrigerating machine oil 113A to a shaft hole 113A of the rotating shaft 104A to further supply the oil to appropriate sliding portions through a branch hole 118 from the shaft hole 117.

When the compressor is started, the roller 107 made of a property-adjusted cast iron is rotated with rotation of the cast iron rotating shaft 104A and the vane 110 made of a high speed steel is pushed by the spring 109 and reciprocally moved in the groove 108 of the cylinder 102, made of a cast iron or an iron base sintered material, while the top end of the vane is maintained in contact with the roller 107. Then, the refrigerant flowing through the refrigerant sucking port is compressed and discharged to the outside of the compressor out of the outlet pipe 129 through the refrigerant outlet port 124. The winding portion 119*a* and the electric insulating film not shown, of the stator 119 are immersed in the refrigerating machine oil in which the refrigerant is dissolved or are exposed to an environment where the mist of the refrigerating machine oil is blowing.

With the combination of the refrigerating machine oil described in Embodiments 1 to 21 and the hydrofluorocabon group refrigerant 134*a* and a combination of the refrigerating machine oil of Embodiments 21 to 37 described above, it was also confirmed that the same effect as in Embodiment 39 could be obtained.

It can be understood from the above that by adding a chemical compound alone or a mixture of chemical compounds selected from the group consisting of the cyclic carbonates and the chain carbonates to a refrigerating machine oil, the refrigerating machine oil composition in accordance with the present invention can suppress abrasion of the sliding portions of the compressor and reduce the friction coefficient without choking the refrigeration system. Particularly, by using a hydrofluorocarbon group refrigerant together with the refrigerating machine oil, a highly reliable refrigeration system can be obtained.

The refrigerating machine oil composition in accordance with the present invention can display its effect in a volumetric compressor, such as a scroll type, a reciprocal type, a screw type or a vane rotary type compressor and so on, and a quantitative type compressor, such as a turbo type compressor and so on.

What is claimed is:

1. A refrigerating machine oil composition, which is composed of a base oil as a main component containing a single component of a compound or a mixture of compounds selected from the group consisting of cyclic carbonates and chain carbonates, wherein said cyclic carbonate is an ethylene-carbonate and chain carbonates.

2. A refrigerating machine oil composition, which is composed of a base oil as a main component containing a single component of a compound or a mixture of compounds selected from the group consisting of cyclic carbonates and chain carbonates, wherein said single component of a compound and said mixture of compounds selected from the group consisting of cyclic carbonates and aliphatic carbonate derivatives are expressed by the following general chemical formulas for cyclic carbonates (1) and aliphatic carbonate derivatives (2):

[Chemical Formulas 1]

(1)

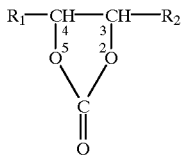

(2)

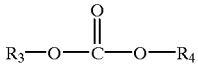

($R_1$, $R_2$ in the formula (1) respectively and independently express a hydrogen atom of a fluorine atom or an alkyl having a carbon number of 1 to 4, or a perfluoroalkyl having a carbon number of 1 to 3, therein, $R_1$ and $R_2$ may be the same or different from each other, $R_3$, $R_4$ in the formula (2) respectively and independently express an alkyl having a carbon number of 1 to 4 or a perfluoroalkyl having a carbon number of 1 to 3, therein, $R_3$ and $R_4$ may be the same or different from each other.).

3. A refrigerating machine oil composition according to claim 2, wherein said cyclic carbonate expressed by the formula (1) is 3-trifluoromethyl-ethylenecarbonate.

4. A refrigerating machine oil composition according to claim 2, wherein said aliphatic carbonate derivatives expressed by the formula (2) is dimethylcarbonate.

5. A refrigerating machine oil, which is composed of a base oil as a main component containing a single component of a compound or a mixture of compounds selected from the group consisting of cyclic carbonates and chain carbonates, which contains 0.01 to 5.0 weight % of said single component of a compound or said mixture of compounds selected from the group consisting of cyclic carbonates and aliphatic carbonate derivatives.

6. A working medium for refrigeration system, which contains any one of the refrigerating machine oils according to claim 1 to claim 5.

7. A refrigeration system, comprising a compressing means, a condensing means an expanding means and an evaporating means, wherein a working medium for a refrigeration system having a hydrofluorocarbon group refrigerant or a hydrocarbon group refrigerant and a refrigerating machine oil contains any one of a single component of a compound and a mixture of compounds selected from the group consisting of cyclic carbonates and aliphatic carbonate derivatives, and wherein said single component of a compound and said mixture of compounds selected from the group consisting of cyclic carbonates and aliphatic carbonate derivatives are expressed by the following general chemical formulas for cyclic carbonates (1) and aliphatic carbonate derivatives (2):

[Chemical Formulas 2]

(1)

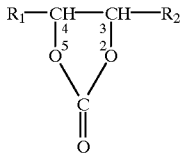

(2)

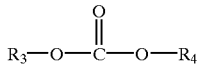

($R_1$, $R_2$ in the formula (1) respectively and independently express a hydrogen atom or a fluorine atom or an alkyl having a carbon number of 1 to 4, or a perfluoroalkyl having a carbon number of 1 to 3, therein, $R_1$ and $R_2$ may be the same or different from each other, $R_3$, $R_4$ in the formula (2) respectively and independently express an alkyl having a carbon number of 1 to 4 or a perfluoroalkyl having a carbon number of 1 to 3, therein, $R_3$ and $R_4$ may be the same or different from each other.).

8. A refrigeration system according to claim 7, wherein said cyclic carbonate expressed by the formula (1) is 3-trifluoromethyl-ethylenecarbonate.

9. A refrigeration system according to claim 7, wherein said chain carbonate expressed by the formula (2) is dimethylcarbonate.

10. A refrigeration system according to any one of claim 7 to claim 9, wherein said refrigerating machine oil contains 0.01 to 5.0 weight % of said single component of a compound and said mixture of compounds selected from the group consisting of cyclic carbonates and aliphatic carbonate derivatives.

11. A compressor comprising a motor having a rotor and a stator, a rotating shaft fixed to said rotor, a circling scroll linked to said rotating shaft and a fixed scroll placed opposite to said circling scroll inside a gastight enclosure storing a working medium containing a refrigerant and a refrigerating machine oil, said refrigerant being compressed by driving of said circling scroll, wherein said working medium is composed of a hydrofluorocarbon group refrigerant or a hydrocarbon group refrigerant and a refrigerating machine oil as main components and contains a single component of a compound or a mixture of compounds selected from the group consisting of cyclic carbonates and aliphatic carbonate derivatives.

12. A refrigerant compressor comprising a motor having a rotor and a stator, a rotating shaft fixed to said rotor, a compressor part connected to said motor through said rotating shaft contained in a gastight enclosure storing a working medium containing a refrigerant and a refrigerating machine oil, a high pressure refrigerant gas delivered out of said compressor part being stored in said gastight enclosure, wherein said working medium is composed of a hydrofluorocarbon group refrigerant or a hydrocarbon group refrigerant and a refrigerating machine oil as main components and contains any one of a single component of a compound and a mixture of compounds selected from the group consisting of cyclic carbonates and aliphatic carbonate derivatives.

* * * * *